US005228769A

United States Patent [19]

Sommerrock et al.

[11] Patent Number: 5,228,769

[45] Date of Patent: Jul. 20, 1993

[54] APPARATUS FOR ILLUMINATING THE INTERIOR OF AN ELEVATOR CAR

[75] Inventors: Brigitte Sommerrock; Rolf Günther; Christian Schäffler, all of München, Fed. Rep. of Germany; Dusan Pibernik, Ebikon, Switzerland

[73] Assignee: Inventio AG, Hergiswil NW, Switzerland

[21] Appl. No.: 881,820

[22] Filed: May 12, 1992

[30] Foreign Application Priority Data

May 13, 1991 [CH] Switzerland ..... 01423/91

[51] Int. Cl.[5] ..... F21S 7/00

[52] U.S. Cl. ..... 362/148; 362/76

[58] Field of Search ..... 362/76, 83.3, 147, 148, 362/227, 249, 364, 458

[56] References Cited

U.S. PATENT DOCUMENTS 4,126,210 11/1978 Martin .
4,164,011 8/1979 Sherwood ..... 362/148
4,704,662 11/1987 Makino .
4,709,308 11/1987 Makino ..... 362/148
4,749,061 6/1988 Orndorff et al. .
5,145,247 9/1992 Mandy ..... 362/148

FOREIGN PATENT DOCUMENTS 0282641 9/1988 European Pat. Off. .
2650579 2/1991 France .

*Primary Examiner*—Richard R. Cole
*Attorney, Agent, or Firm*—William J. Clemens

[57] ABSTRACT

An elevator car has a passenger space bounded by a pair of side walls and a ceiling with a fluorescent tube attached to the ceiling and a ceiling frame suspended from the ceiling and supporting translucent filler panels. An opaque middle ceiling strip is attached to the ceiling frame between two of the filler panels and below and in longitudinal alignment with the fluorescent tube. A pair of spot lamps are attached to an upper surface of the middle ceiling strip and are exposed through holes in the strip to illuminate predetermined areas of the side walls containing destination floor actuating elements and information panels for the floors. The middle ceiling strip has one side rotatably attached to the ceiling frame by a hinge connector for providing access to change the fluorescent tube and the spot lamps. The strip also is releasably retained by a locking bar on the other side thereof which engages the ceiling frame and can be released with the aid of a simple tool.

13 Claims, 3 Drawing Sheets

APPARATUS FOR ILLUMINATING THE INTERIOR OF AN ELEVATOR CAR

BACKGROUND OF THE INVENTION

The present invention relates generally to elevator systems and, in particular, to an apparatus for illuminating the passenger space of an elevator car.

Equipment for illuminating the interior of an elevator promotes the safe boarding of the passenger space, the safe operation of the actuating controls for the destination floor selection, a pleasant stay in the passenger space during the trip and a safe leaving of the passenger space for the passengers.

An elevator car in which lamp holders are slidably mounted on tracks fixed to the roof of the car is shown in the U.S. Pat. No. 4,126,210. The lamp holders are arranged for the reception of several illuminating tubes which tubes are concealed by a suspended ceiling including an exchangeable and translucent light diffusing shield. The ceiling has adjustable brackets such that the illuminating tubes can be horizontally adjusted and the ceiling can be vertically adjusted to change the illumination pattern on the shield, the illumination level in the passenger space and the light distribution in the passenger space.

A disadvantage of the above-described illumination equipment is that the translucent shield is not capable of distributing the light so as to provide a uniformly illuminated surface. A further disadvantage is that when exchanging a deflective illuminating tube, the shield panels which have a large surface area and can be damaged easily must be removed and leaned against a car wall or deposited on the car floor before the defective light source can be exchanged.

SUMMARY OF THE INVENTION

The present invention concerns an apparatus for the illumination of the passenger space of a elevator car utilizing translucent filler panels arranged in a ceiling frame underneath a ceiling of the elevator car and with at least one light source fastened at the ceiling between the filler panels and the ceiling. The invention is therefore based on the task of providing an apparatus for the illumination of a passenger space of a elevator car, which apparatus illuminates the passenger space maximally and uniformly and in which the replacement of a defective light source can be performed simply and safely.

An elevator car has a passenger space bounded by a pair of side walls, a rear wall, a floor and a ceiling. At least a pair of translucent filler panels are arranged in a ceiling frame suspended beneath the ceiling and at least a first light source, such as a fluorescent tube, is attached to the ceiling. An opaque middle ceiling strip is releasably and rotatably attached to the ceiling frame for movement away from and toward the ceiling. The middle ceiling strip extends between the side walls and is positioned below the first light source and between the filler panels. At least one opening is formed in the middle ceiling strip and at least a second light source is attached to an upper side of the middle ceiling strip in alignment with the one opening for illuminating a predetermined area of one of the side walls of the elevator car. The second light source can be a spot lamp and a wire clamp is attached to the upper surface of the middle ceiling strip for retaining the spot lamp. A connector, such as a hinge, rotatably attaches the middle ceiling strip to the ceiling frame and at least one locking bar actuatable by a tool is attached to the middle ceiling strip for releasably attaching the strip to a metal retaining plate attached to the ceiling frame.

The advantages achieved by the present invention are substantially that all the light sources are arranged in the region of the middle strip of the car ceiling, which strip is included in a band running down the two side walls and along the ceiling and the floor, such that the translucent filler panels on both sides of the middle strip are uniformly illuminated. Those portions of the side walls which are included in the encircling band, with the floor selection controls located on one side and the printed instructions to the floors located on the other side, are always illuminated by respective spot lamps even in the case of a frequently used elevator car. The exchange of the spot lamps as well of the fluorescent tube is facilitated thereby in that the upper middle strip can be unlocked with the aid of a key or a tool and can be tilted away on hinges. Thus, access is provided to the fluorescent tube fastened at the car ceiling as well to the spot lamps fastened in the middle strip without having to remove any ceiling panels.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
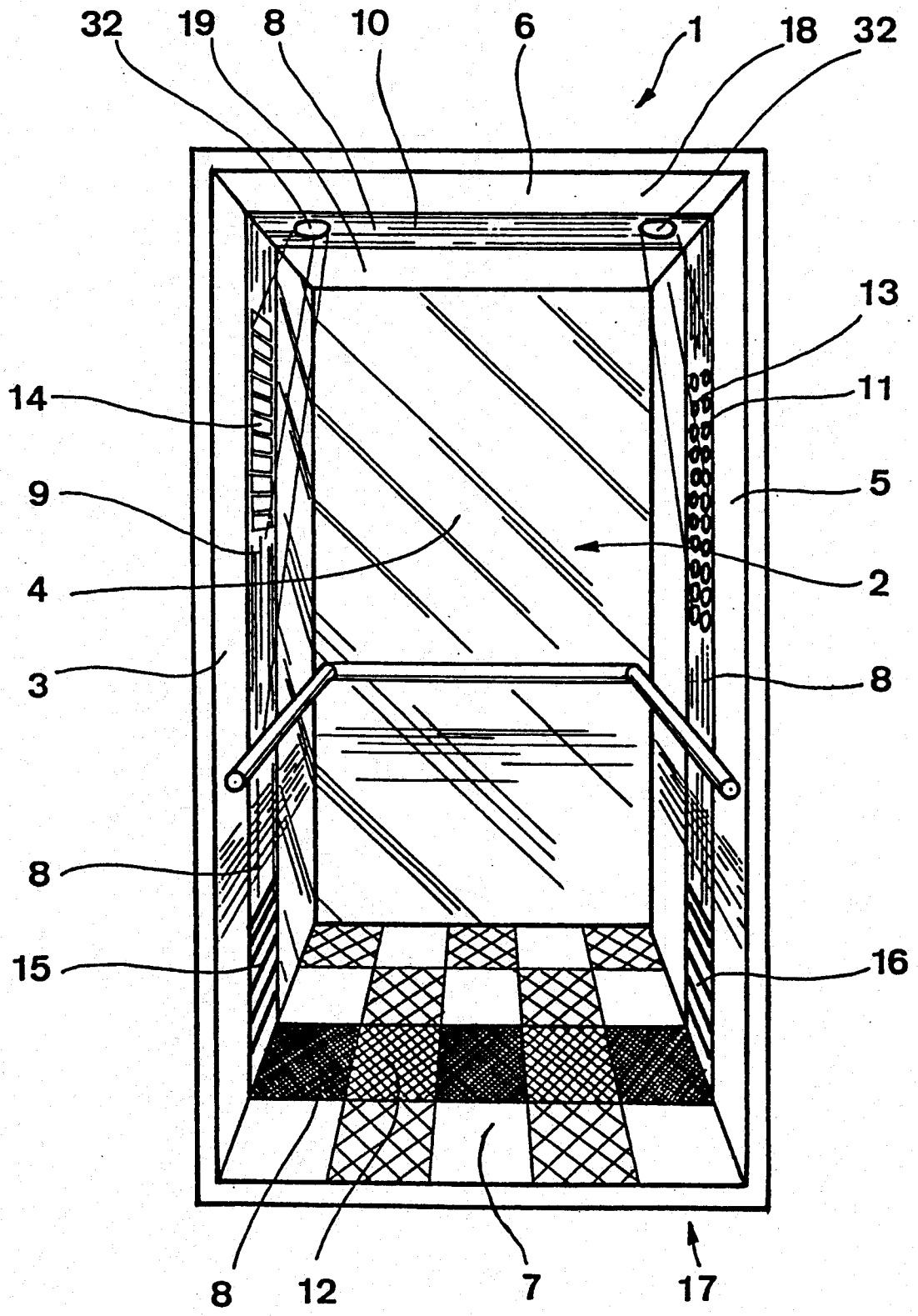
FIG. 1 is a perspective view of a elevator car with the car door removed to show the illumination apparatus according to the present invention.

An interior of an elevator car 1 is shown in the FIG. 1. A passenger space 2 of the elevator car 1 is bounded by a left-hand side wall 3, a rear wall 4, a right-hand side wall 5, a ceiling 6 and a floor 7. The entry into the passenger space 2 or the exit from the same takes place through an access 17 which is provided with doors (not shown). The surface areas of the left-hand side wall 3, the ceiling 6, the right-hand side wall 4 and the floor 7 are each divided into three individual areas by a continuous middle strip 8 extending around the passenger space 2 and located between the rear wall 4 and the access 17. The strip 8 is composed of a left-hand middle strip 9, a middle ceiling strip 10, a right-hand middle strip 11 and a middle floor strip 12. Typically, a plurality of actuating elements 13 for the destination floor selection are integrated into the right-hand middle strip 11 and printed information panels 14 for the individual floors are integrated into the left-hand middle strip 9. Ventilation slots 15 and 16 for the ventilation of the elevator car 1 are located in above the floor in both middle strips 9 and 11.

Figure 2:
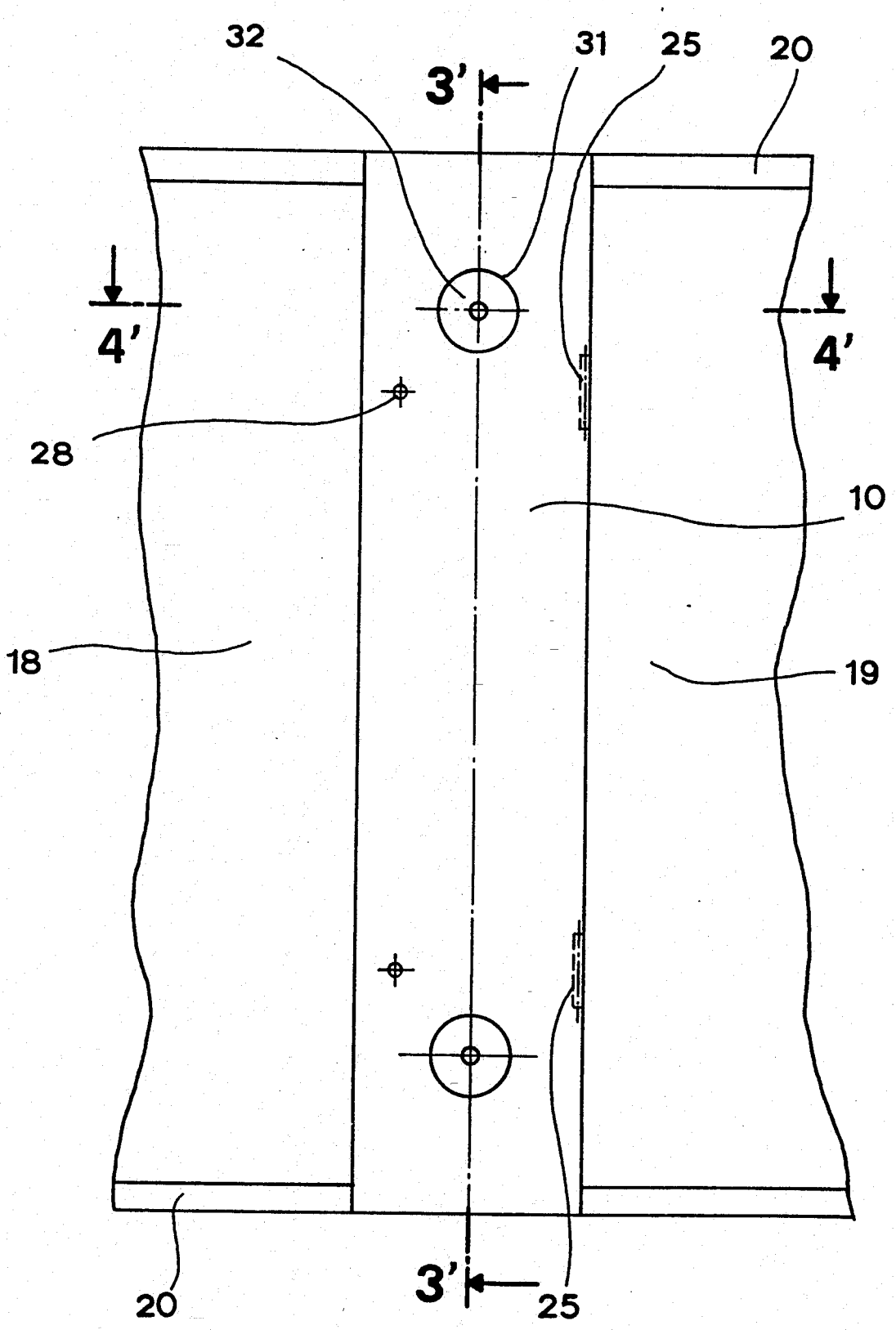
FIG. 2 is a bottom plan view of a portion of the car ceiling shown in the FIG. 1 with the middle ceiling strip, the filler panels and the spot lamps shown.
Figure 3:
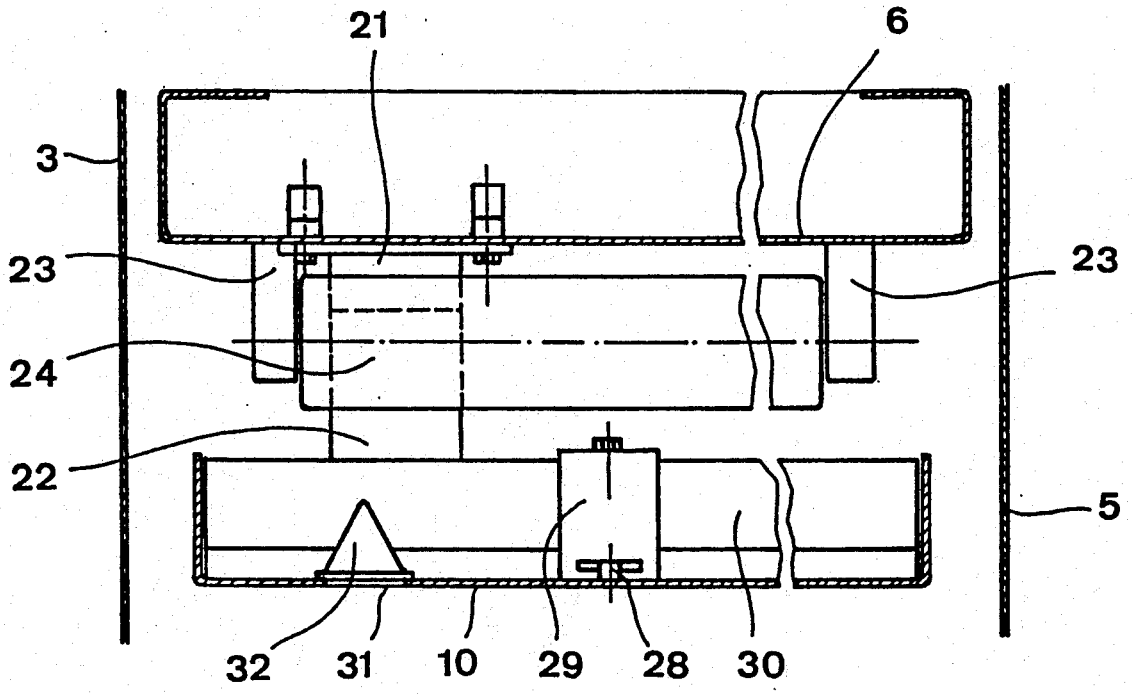
FIG. 3 is a cross-sectional view of the car ceiling taken along the section line 3'—3' in the FIG. 2.
Figure 4:
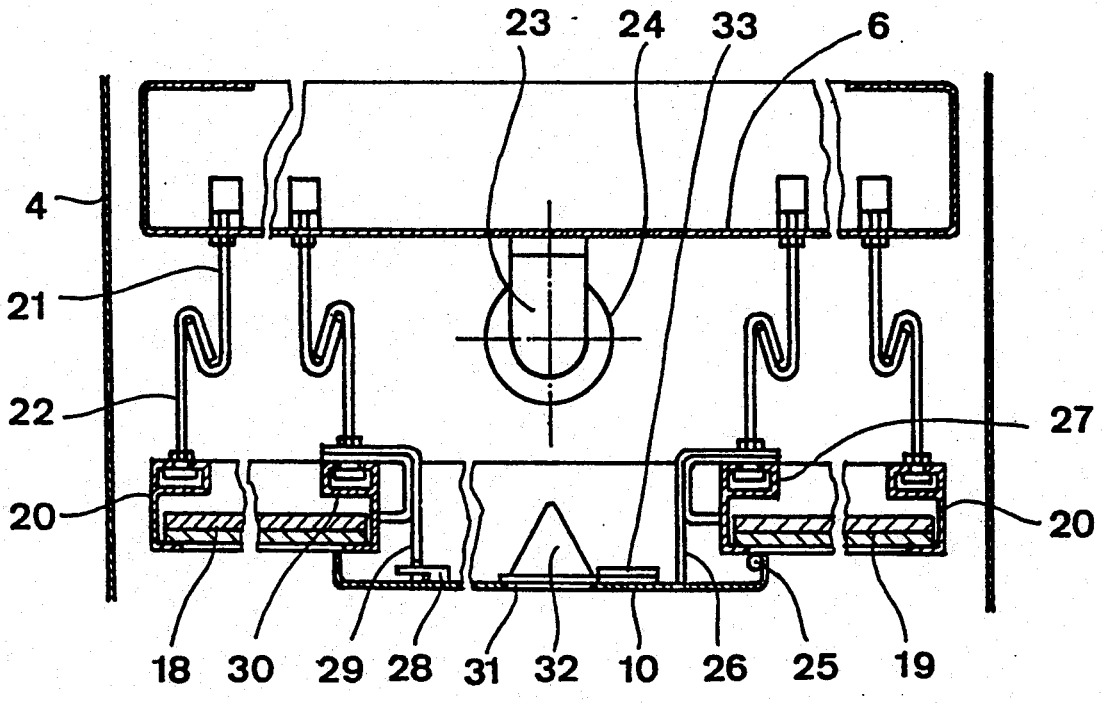
FIG. 4 is a cross-sectional view of the car ceiling taken along the section line 4'—4' in the FIG. 2.

The middle ceiling strip 10 is illustrated in greater detail in the FIGS. 2, 3 and 4. The ceiling strip 10 is formed of an opaque material and is suspended from the ceiling 6 together with a ceiling frame 20 which corresponds approximately to the dimensions of the ceiling 6 of the elevator car 1. The frame 20 receives a translucent left-hand filler panel 18 and a translucent right-hand filler panel 19 on opposite sides of the middle ceiling strip 10. Adjustable suspension brackets 21 are attached to the ceiling 6 and suspension hooks 22 are attached to the frame 20 to permit an exact vertical orientation of the ceiling frame 10. The translucent filler panels 18 and 19 are loosely laid into the ceiling frame 20. Holders 23 for the reception of a fluorescent tube 24 are fastened to the ceiling 6 at the center line of the middle ceiling strip 10. The fluorescent tube 24 is completely concealed by the non-translucent middle ceiling strip 10 so that both the left-hand and right-hand filler panels 18 and 19 respectively, which are arranged laterally beside the middle ceiling strip 10, are indirectly illuminated evenly by the fluorescent tube 24.

The middle ceiling strip 10 is connected at one longitudinal side by a hinge connector 25 to a first transverse support 27 of the ceiling frame 20 to be tiltable away from contact with a first metal retaining plate 26 of the ceiling frame. The other longitudinal side of the middle ceiling strip 10 is normally releasably retained by at least one locking bar 28 engaging a second metal retaining plate 29 of a second transverse support 30 of the ceiling frame 20. An opening 31 is formed at each end of the middle ceiling strip 10 behind which a spot lamp 32 is arranged which lamp is replaceable.

The middle ceiling strip 10 extends across the ceiling 6 of the elevator car 1 from the left-hand side wall 3 to the right-hand side wall 5 and is fastened to the metal retaining plate 26 of the first transverse support 27 to be rotated away from the ceiling frame 20 with the aid of the hinge 25. Provided on the opposite longitudinal side of the middle ceiling strip 10 are one or more of the locking bars 28 which are detentable in the metal retaining plate 29 of the second transverse support 30 of the ceiling frame 20. The locking bar 28 can be so constructed that it can be actuated, for example, by a key or by a screwdriver. Upon the unlocking of the locking bar 28, the middle ceiling strip 20 tilts vertically downwards about the connector 25 and provides access to the fluorescent tube 24 which is secured by the holder 23 fastened at the ceiling 6 of the elevator car 1. At the same time, access is also provided to the spot lamps 32 which are retained by wire clamps 33 attached to the upper surface of the middle ceiling strip 10 by crimped contacts. The middle ceiling strip 10 is not translucent and can be made, for example, of a bent metal plate. The fluorescent tube 24 is thus concealed from the passenger compartment 2 by the middle ceiling strip 10 so that its luminous output acts upwardly and laterally, whereby both the translucent filler panels 18 and 19 positioned to the left and right beside the middle ceiling strip 10 are illuminated evenly. The spot lamps 32, which are fastened at each end of the middle ceiling strip 10 on the upper side thereof, illuminate the left-hand and the right-hand middle strips 9 and 11 of the left-hand and the right-hand side walls 3 and 4 respectively through the openings 31 in the middle ceiling strip 10 and thereby illuminate the floor numbers on the actuating elements 13 and the information panels 14 for the individual floors.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In an elevator car having a passenger space bounded by a pair of side walls and a ceiling, translucent filler panels arranged in a ceiling frame suspended beneath the ceiling, and at least one light source attached to the ceiling, an apparatus for illuminating the passenger space comprising: an opaque middle ceiling strip releasably and rotatably attached to the ceiling frame for movement away from and toward the ceiling, said middle ceiling strip extending between the side walls and positioned below the one light source and between at least two of the filler panels, at least one opening formed in said middle ceiling strip, at least a second light source attached to an upper side of said middle ceiling strip in alignment with said opening for illuminating a predetermined area of one of the side walls of the elevator car.

2. The apparatus for illuminating according to claim 1 wherein the one light source attached to the ceiling of the elevator car includes a fluorescent tube.

3. The apparatus for illuminating according to claim 1 wherein said second light source is a spot lamp.

4. The apparatus for illuminating according to claim 3 including a wire clamp attached to said upper surface of said middle ceiling strip for retaining said spot lamp.

5. The apparatus for illuminating according to claim 1 including a hinge connector rotatably attaching said middle ceiling strip to the ceiling frame of the elevator car.

6. The apparatus for illuminating according to claim 1 including at least one locking bar actuatable by a tool and attached to said middle ceiling strip for releasably attaching said middle ceiling strip to the ceiling frame.

7. The apparatus for illuminating according to claim 1 including a metal retaining plate attached to the ceiling frame of the elevator car for releasably engaging said locking bar.

8. In an elevator car having a passenger space bounded by a pair of side walls and a ceiling, a pair of translucent filler panels arranged in a ceiling frame suspended beneath the ceiling, and a fluorescent tube attached to the ceiling, an apparatus for illuminating the passenger space comprising: an opaque middle ceiling strip releasably and rotatably attached to the ceiling frame for movement away from and toward the ceiling, said middle ceiling strip extending between the side walls and positioned below the fluorescent tube and between the filler panels, a pair of openings formed in said middle ceiling strip, a pair of spot lamps attached to an upper side of said middle ceiling strip in alignment with said openings for illuminating predetermined areas of the side walls of the elevator car.

9. The apparatus for illuminating according to claim 8 including a pair of wire clamps attached to said upper surface of said middle ceiling strip for retaining said spot lamps.

10. The apparatus for illuminating according to claim 8 including a hinge connector rotatably attaching said middle ceiling strip to the ceiling frame of the elevator car and at least one locking bar actuatable by a tool and attached to said middle ceiling strip for releasably attaching said middle ceiling strip to the ceiling frame.

11. An elevator car comprising: a passenger space bounded by a pair of side walls, a rear wall, a floor and a ceiling; at least a pair of translucent filler panels arranged in a ceiling frame suspended beneath said ceiling; at least a first light source attached to said ceiling; an opaque middle ceiling strip releasably and rotatably attached to said ceiling frame for movement away from and toward said ceiling, said middle ceiling strip extending between said side walls and positioned below said first light source and between said filler panels; at least one opening formed in said middle ceiling strip; and at least a second light source attached to an upper side of said middle ceiling strip in alignment with said one opening for illuminating a predetermined area of one of said side walls of the elevator car.

12. The elevator car according to claim 11 wherein said second light source is a spot lamp and including a wire clamp attached to said upper surface of said middle ceiling strip for retaining said spot lamp.

13. The elevator car according to claim 11 including a hinge connector rotatably attaching said middle ceiling strip to said ceiling frame of the elevator car, at least one locking bar actuatable by a tool and attached to said middle ceiling strip for releasably attaching said middle ceiling strip to said ceiling frame, and a metal retaining plate attached to said ceiling frame for releasably engaging said locking bar.

* * * * *